US006766788B2

(12) United States Patent
Xu

(10) Patent No.: US 6,766,788 B2
(45) Date of Patent: Jul. 27, 2004

(54) PRE-CHARGING STRATEGY FOR FUEL INJECTOR FAST OPENING

(75) Inventor: Min Xu, Canton, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 33 days.

(21) Appl. No.: 10/061,566

(22) Filed: Jan. 31, 2002

(65) Prior Publication Data

US 2003/0140898 A1 Jul. 31, 2003

(51) Int. Cl.[7] ..... F02M 37/04
(52) U.S. Cl. ..... 123/490; 361/152
(58) Field of Search ..... 123/490, 478; 361/152, 154

(56) References Cited

U.S. PATENT DOCUMENTS

| | | | |
|---|---|---|---|
| 3,982,505 | A | 9/1976 | Rivere |
| 4,284,051 | A | 8/1981 | Maisch |
| 4,345,564 | A | 8/1982 | Kawamura et al. |
| 4,350,132 | A | 9/1982 | Harsch et al. |
| 4,599,674 | A | 7/1986 | Ishikawa et al. |
| 5,955,792 | A | 9/1999 | Fischer et al. |
| 6,142,124 | A | 11/2000 | Fischer et al. |

FOREIGN PATENT DOCUMENTS

| | | |
|---|---|---|
| DE | 195 18 267 A1 | 5/1995 |
| DE | 198 08 780 A1 | 3/1998 |
| EP | 1 122 416 A2 | 12/2000 |

*Primary Examiner*—Bibhu Mohanty
(74) *Attorney, Agent, or Firm*—Brinks Hofer Gilson & Lione

(57) ABSTRACT

Minimizing fuel injector opening time greatly improves fuel efficiency and performance. Pre-charging the fuel injector solenoid is an inexpensive means of reducing opening time. The solenoid is pre-charged to a level that is slightly below a current level that would move an armature located near the solenoid for a known period. A larger current is then applied to the solenoid which moves the armature quickly to an open position. A current is then applied that is less than the pre-charging or valve-opening current to hold the armature in a open position. Finally, all current is removed from the solenoid, allowing the armature to return to a closed position.

20 Claims, 5 Drawing Sheets

PRE-CHARGING STRATEGY FOR FUEL INJECTOR FAST OPENING

FIELD OF THE INVENTION

The present invention relates to an apparatus and method for driving a fuel injector. In particular, the invention relates to an apparatus and method for controlling the quantity and rate of fuel to be injected into an internal combustion engine.

BACKGROUND OF THE INVENTION

Fuel injectors typically use a solenoid that controls an armature. When a current is applied to the solenoid, a magnetic field is created, which raises the armature against spring and fuel pressure forces, and allows fuel to flow. When the current is removed, the armature returns to a closed position by the bias of the spring and fuel flow is terminated. Fuel injector opening time and closing time are important parameters in fuel injection strategies. Short opening and closing times create a longer linear flow range. A longer linear flow range results in lower idle speed, improved idle stability, fuel savings on deceleration, more precise fuel control at low loads, and hydrocarbon emission reduction. Prior methods of shortening injector response time have attempted to reduced the electrical resistance in the solenoid coil or increase the voltage applied to the solenoid. Lower resistance in the given size coil, however, results in less magnetic force, reducing the effectiveness of the solenoid. Increasing voltage requires the use of a DC—DC converter, increasing costs. Furthermore, the higher voltage creates and dissipates more heat into the local electronics. Therefore, the device cannot be integrated into other electronic devices.

Other devices have pre-charged (or pre-magnetized) the solenoid with a current that is below the current that can move the armature. This pre-charging current reduces the time required for the current in the solenoid to increase to an opening level. Some devices apply a constant, low-level current to the solenoid. This strategy reduces opening time, but it also reduces the effective spring closing force, hence increases the possibility of false opening due to high back-pressure during combustion and leakage. This strategy requires high energy consumption. Other pre-charging devices do not apply a continuous current, but instead apply a pre-charging current for a limited time before opening. These devices often require expensive circuitry for a closed-loop control of the pre-charging current and are not optimized to minimize current use. Therefore, a fast, inexpensive device and method are required to minimize opening time and reduce energy consumption without some of the shortcomings described above.

BRIEF SUMMARY OF THE INVENTION

In one embodiment of the invention, a voltage source is provided. The voltage source is electrically connected to a drive circuit for limiting the current from the voltage source to an injector solenoid. An engine controller is connected to the circuit and dictates the timing and duration that the circuit performs for each injector. The circuit determines the current-limiting waveform of the injector solenoid. When the driving voltage pulse is sent to the solenoid coil, current begins to build up in the coil and creates a magnetic field. An armature is located inside the injector as a part of the solenoid magnetic circuit and has a thin axial air gap to the rest part of the solenoid magnetic circuit. The armature moves toward the counterpart pole face to close the air gap in response to the magnetic flux. The armature movement dictates the injector needle valve lift that controls the amount of fuel that flows into the internal combustion engine. When a magnetic flux is not applied, a spring keeps the armature in a closed position, preventing fuel flow.

In a second embodiment of the invention, a method of controlling a current in a solenoid coil to move an armature in a fuel injector is provided. The method applies a pre-charging current at a level that does not move the armature for a period until the pre-charging current level is achieved and stabilized. The method then applies a valve-opening current that is greater than the pre-charging current and has an upper limit sufficient to fully move said armature. Next, a valve-holding current is applied that is less than the valve-opening current and the pre-charging current but just sufficient to keep the armature in fully open position. Finally, all current is removed, allowing the armature to close.

In another embodiment of this invention, various means are provided for applying a pre-charging current, a valve-opening current, and a holding current to the armature and solenoid assembly.

Other systems, methods, features, and advantages of the invention will be or will become apparent to one skilled in the art upon examination of the following figures and detailed description. All such additional systems, methods, features, and advantages are intended to be included within this description, within the scope of the invention, and protected by the accompanying claims.

BRIEF DESCRIPTION OF SEVERAL VIEWS OF THE DRAWINGS

The invention may be better understood with reference to the following figures and detailed description. The components in the figures are not necessarily to scale, emphasis being placed upon illustrating the principles of the invention. Moreover, like reference numerals in the figures designate corresponding parts throughout the different views.

DETAILED DESCRIPTION OF THE PRESENTLY PREFERRED EMBODIMENTS

The invention will be described in connection with an internal combustion engine in which a solenoid-actuated injector controls the fuel flow into a cylinder of the engine.

Figure 1:
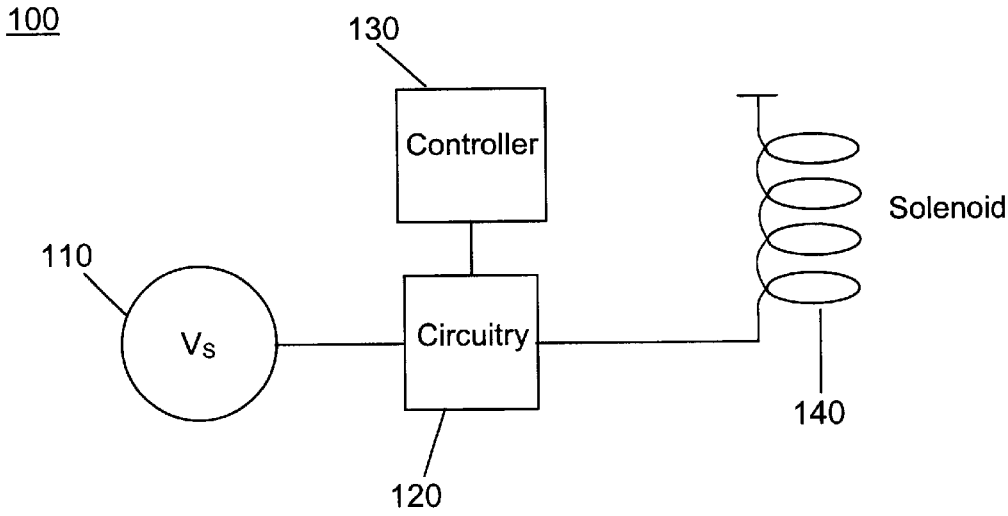
FIG. 1 is a schematic diagram of a preferred embodiment of a device for pre-charging a fuel injector solenoid, in accordance with the present invention.

FIG. 1 depicts a control system 100 for the current supplied to a solenoid coil 140. The voltage for the solenoid 140 is supplied by a voltage supply 110. In the preferred embodiment, the 14-volt voltage supply 110 provides a low voltage. This voltage is typically a voltage used by other vehicle components, although other voltages may be utilized. The voltage supply 110 is electrically connected to current limiting driver circuitry 120. The circuitry 120 is configured to provide at least three different currents: a pre-charging current, a valve-opening current, and a valve-holding current. The circuitry in the preferred embodiment is a current divider circuit. The circuitry 120 receives signals from a controller 130. The controller 130 is a part of the engine control module. The controller determines when the current should be applied to each injector and how long the current should be applied. The circuitry 120 then applies the current to the solenoid 140. The current in the solenoid 140 then creates a magnetic force to lift the armature.

Figure 2:
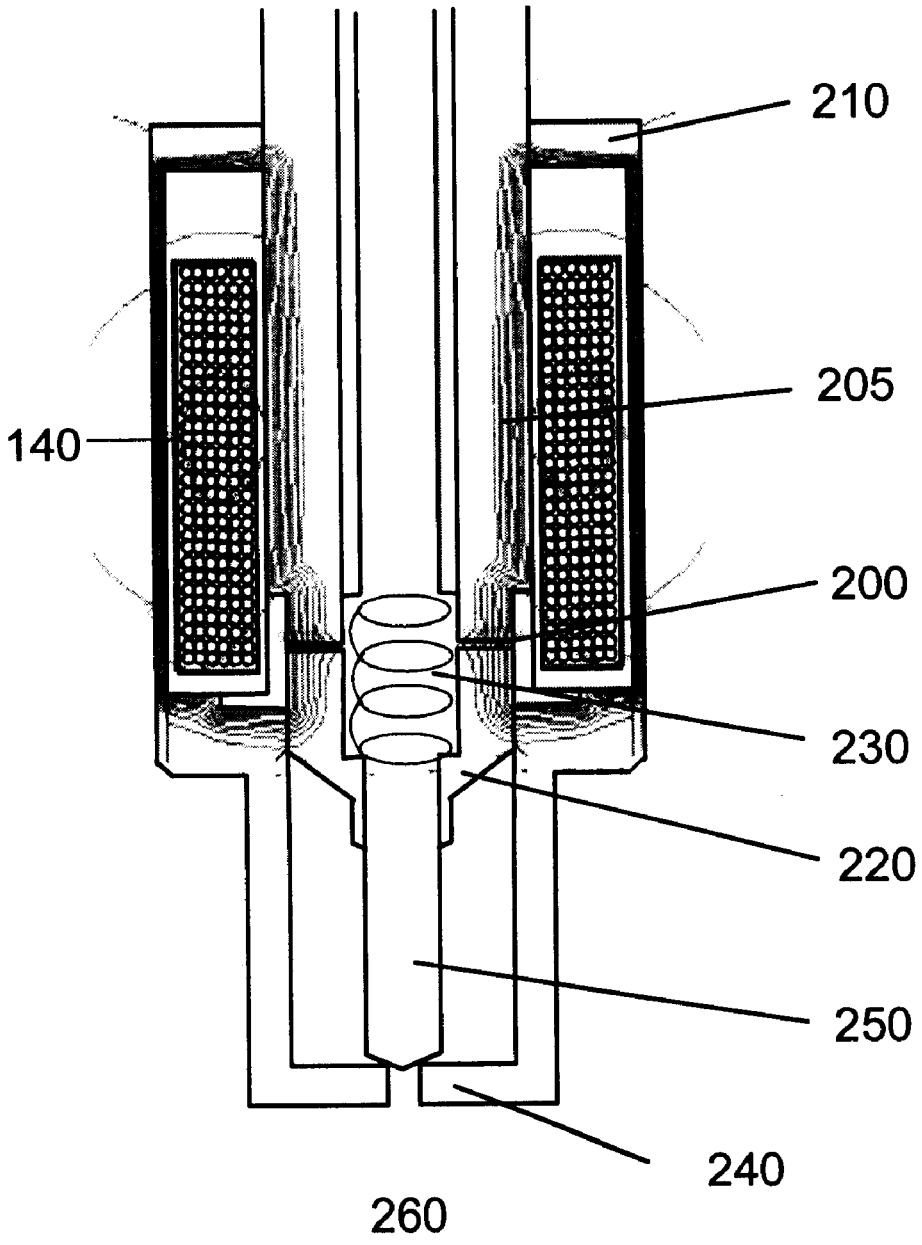
FIG. 2 is a side view of the solenoid armature of FIG. 1 and cylinder opening, in accordance to the present invention.

FIG. 2 illustrates a view of the solenoid and armature configuration. The solenoid coil 140 receives current from the current limiting driver circuitry 120 (FIG. 1) and creates a magnetic field within the magnetic circuit 210. In the present exemplary embodiment, the armature 220 is located within the solenoid magnetic circuit 210 with a small axial air gap 200 to the counterpart pole face. The armature 220 reacts to the magnetic flux 205 built up within the magnetic circuit 210 by moving upwardly to close the air gap 200 according to the right hand rule. The armature is biased in a closed position by a spring 230. The spring 230 retains a needle valve 250 in contact with an injector valve seat 240 to place the valve in a closed position when there is no magnetic force or an insufficient magnetic force is applied to open it. Therefore, the magnetic force must be sufficient to overcome the fuel pressure force and the spring preload. Fuel pressure force is the pressure the fuel exerts on the armature 220 and needle valve 250, when the valve 250 is in a closed position. Therefore, when the magnetic force drops below the spring pre-load force, the needle valve 250 plugs the injector seat opening 240 and prevents fuel from flowing into a cylinder of the engine 260.

Figure 3:
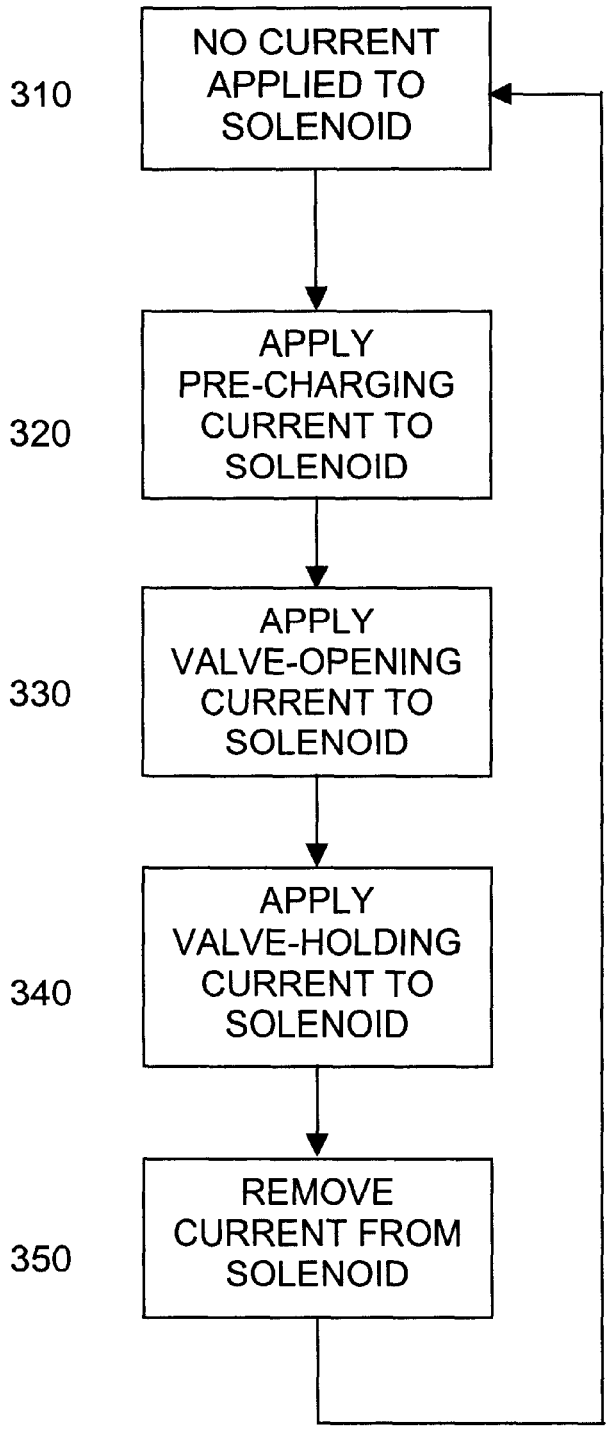
FIG. 3 illustrates a flow diagram of the method used in pre-charging a fuel injector solenoid, in accordance with another embodiment of the present invention.

FIG. 3 illustrates a flow diagram of the method of the embodiment in operation. In FIG. 3, the operation begins with no current in the solenoid coil 140 (FIG. 1) 310. A pre-charging current is then applied 320 when an injection command signal is sent to the driver circuit 120 (FIG. 1). The pre-charging current is slightly below the current level which will cause the armature 220 (FIG. 2) to move. The pre-charging current must, however, be far enough below the level to ensure that false openings do not occur. False openings occur when the armature moves before a valve-opening current is applied. In the present exemplary embodiment, a balance is struck by choosing a current that is 0.1 amps under the current level wich would cause the armature 220 (FIG. 2) to move. The pre-charging duration should be long enough to ensure current stabilization and consistent opening. In the present exemplary embodiment, for a coil with an impedance of 0.17 ohms and a voltage supply of 12 volts, the pre-charge current should be 2.8 amps and the pre-charging duration should be approximately 3 milliseconds. A valve-opening current 330 is then applied at the moment that the injector must inject fuel into the engine. The valve-opening current provides enough current to increase the magnetic flux across the air gap and generate a force larger than the closing force, allowing the armature to move, and creating an opening between the needle valve and seat through which fuel can flow. The opening current must create a magnetic force greater than the fuel pressure force and the spring pre-load.

In the present exemplary embodiment, in order to achieve a fast initial current buildup at the low voltage supply for the required fast opening, the coil inductance is selected to be quite low. With the low inductance, the coil saturation current has the potential to reach several hundred amps, which is substantially higher than the current necessary for the armature to reach its fully open position. The saturation current is the maximum amount of current that can be present in the coil. Not only would this excessive current have no benefit to the injector opening, but it would also have the negative effect of adding a thermal load to the system. This thermal load would likely cause circuit damage. Therefore, to prevent excessive energy consumption and driver circuit damage, the driver circuit limits the current to a level sufficient to open the armature fully. Once this current is reached, the current is held for a predetermined period, ensuring that the injector is fully open and has a constant opening time. During this time, the current plateaus. Without the plateau, the fuel flow cannot be continually linear.

As an example, In the present exemplary embodiment, the peak current allowed by the circuitry is 8.0 amps and the this current is applied for 0.4 milliseconds. After the valve-opening current is applied, a valve holding current is applied 340. The valve-holding current creates a force that is slightly greater that the spring pre-load force, thereby holding the injector in the open position. The valve-holding current is, however, lower than the pre-charging current and the valve-opening current. Because the valve-holding current is lower than the pre-charging current or the valve-opening current, the valve-holding current has the advantages of faster closing time, lower power consumption, and lower residual magnetic sticking at the valve closing.

Residual magnetic sticking occurs when some magnetic field strength remains during the demagnetization after the current is removed. This tends to have a negative effect on injector closing time. The hold current level, however, must be sufficient to prevent accidental closing during the period when the hold current is applied. Once again, in the present exemplary embodiment, a balance is struck by choosing a current that is 0.1 amp higher than the current that would allow the injector to close. The hold current is 1.4 amps and the duration is between 0 and 6 milliseconds depending on the command signal from the controller 130 (FIG. 1). Finally, the current is quickly and completely removed 350. The immediate removal of the current ensures a quick closing time. The quick closing time results in fuel efficiency and lowered hydrocarbon emissions. The pre-charging current level and duration, the peak current level and duration, the hold current and duration are predetermined and present within the injector driver circuit 120 (FIG. 1). This preset driving current waveform is preferably trimmed by the injection pulse command signal from the engine control module 130 (FIG. 1).

Figure 4:
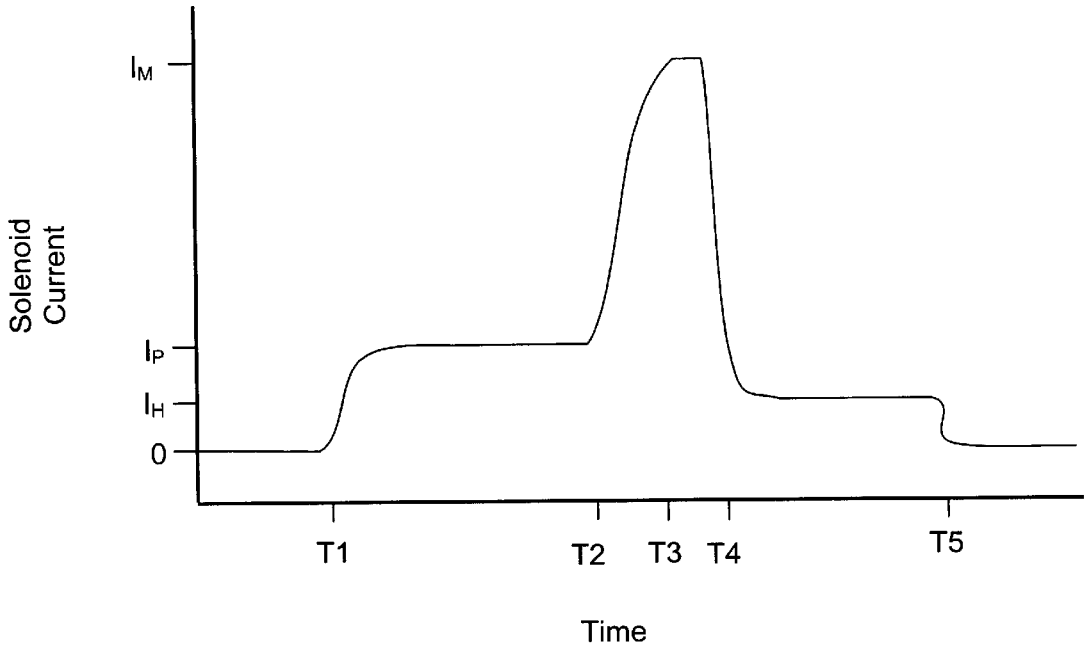
FIG. 4 is a diagram of the solenoid current during one cycle of operation, according to the invention.

FIG. 4 graphically illustrates the currents in the solenoid over one cycle of operation. From T0 to T1 the solenoid has no current. At T1, the pre-charging voltage $V_p$ is applied, and the current gradually rises according to the solenoid inductance. Finally, the pre-charging current $I_P$ is reached. From T1 to T2, the pre-charging current rises and plateaus at a current slightly below a current level that would move the armature 220 (FIG. 2). From T2 to T3, the solenoid current increases until it reaches the peak current $I_M$. During this time, the armature moves up to close the air gap, and the connected needle valve separates from the valve seat and fuel is allowed to flow. At T3, the current reaches the peak current and plateaus because of the current limiting circuit. At T4, the current quickly drops to its valve-holding current $I_H$. From T4 to T5, the current in the solenoid is limited at the valve-holding current $I_H$. Between these two points, the armature remains displaced and there is linear flow of fuel. At T5, the current is suddenly cut and the solenoid has no current. At this point, the spring forces the needle valve to make contact with the cylinder valve seat into the closed position, preventing fuel from flowing.

Figure 5:
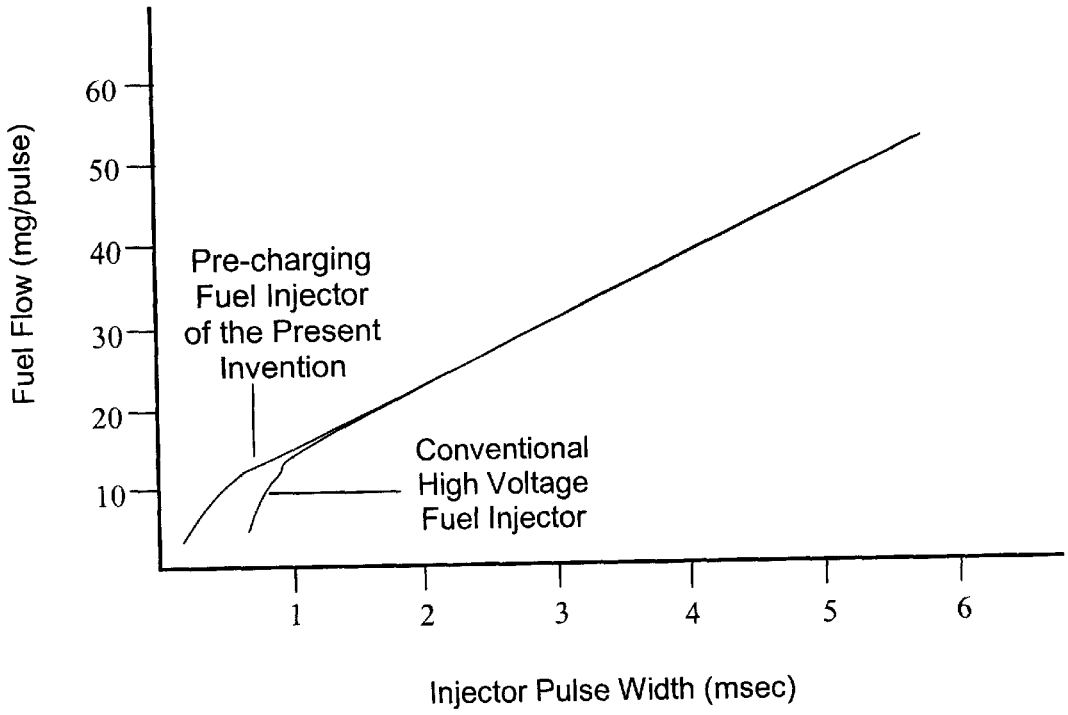
FIG. 5 illustrates a graph showing the comparative operation of the fuel injector of the present invention and a fuel injector using high voltage.

FIG. 5 represents the injector flow rate versus injector pulse width. The two slopes represent the current embodiment and a device without pre-charging at a high voltage. The slope of the device without pre-charging drops quickly when the injector pulse width approaches zero. Unlike the slope of the device without pre-charging, the present embodiment has a slope that continues to be linear when the pulse width approaches zero. This linear flow improves idle and low load performance, as well as reducing fuel consumption and hydrocarbon emissions.

Various embodiments of the invention have been described and illustrated. The description and illustrations are by way of example only. Many more embodiments and implementations are possible within the scope of this invention and will be apparent to those of ordinary skill in the art. Therefore, the invention is not limited to the specific details, representative embodiments, and illustrated examples in this description. Accordingly, the invention is not to be restricted except in light as necessitated by the accompanying claims and their equivalents.

What is claimed is:

1. A fuel injector drive system for use in an internal combustion engine of a vehicle comprising:

a solenoid;

a armature mounted adjacent to said solenoid for controlling the amount of fuel entering said internal combustion engine;

a spring operatively connected to said armature which holds said armature in a closed position when a magnetic force generated by said solenoid is not sufficient to overcome a biasing force of said spring;

a circuit electrically connected to said solenoid which selectively provides a pre-charging current with an amperage nominally below an amperage necessary to move said armature for a period sufficient to plateau the pre-charging current level, a valve-opening current with an amperage much above an amperage necessary to move the armature but less than the maximum possible current level of the coil, for a period sufficient to ensure full opening, and a holding current with an amperage nominally above an, amperage necessary for said armature to return to said closed position for a period sufficient to provide said engine with fuel;

a controller in electrical communication with said circuit for controlling time and duration of the application of said currents by said circuit; and a voltage source in electric communication with said circuitry for providing said circuit various voltages to obtain the said various current levels within the solenoid coil.

2. The fuel injector drive system of claim 1 wherein said voltage source supplies a voltage at or near an operating voltage of said vehicle.

3. The fuel injector system of claim 1 wherein said armature is located within said solenoid.

4. A method of controlling a current in a solenoid to move an armature of a fuel injector between an opening and a closing position in a fuel injector drive system comprising the steps of:

applying a pre-charging current to said solenoid at a level that does not move the armature for a period sufficient to plateau the pre-charging current;

applying a valve-opening current, which is much greater than said pre-charging current and has an upper limit sufficient to fully move said armature to an open position but is less than the maximum possible current level of the coil, for a period sufficient to ensure full opening;

applying a valve-holding current, which is less than said valve-opening current and said pre-charging current for a period sufficient to provide said internal combustion engine with fuel;

removing current, allowing said armature to return to said closing position.

5. The method of claim 4 wherein said pre-charging current further comprises an amount slightly below a current necessary to move said armature.

6. The method of claim 5 wherein said step of applying a pre-charging current further comprises applying said pre-charging current for a period long enough for the current to be stable and provide a stable and consistent opening, but short enough to prevent over-magnetization and false openings.

7. The method of claim 4 wherein said step of applying a valve-opening current further comprises a current that rises until it reaches a peak current, which is at a current at which opening time is minimized.

8. The method of claim 4 wherein said valve-holding current is greater than a current that would allow said armature to move to a position that the said armature would be in if no current were applied.

9. The method of claim 4 where said removing of current is instantaneous, so that the current in said solenoid instantaneously drops to zero.

10. An apparatus for controlling a current in a solenoid to move an armature of a fuel injector between an opening and a closing position in a fuel injector drive system, said apparatus comprising:

a means for applying a pre-charging current to said solenoid at a level that does not move said armature for a period sufficient to plateau said pre-charging current;

a means for applying a valve-opening current which is much greater than said pre-charging current and has an upper limit sufficient to fully move said armature to an open position but less than the maximum current level of the coil, for a period sufficient to provide said internal combustion engine with fuel; and a means for removing current, allowing said armature to return to said closing position.

11. The apparatus of claim 10 wherein said means for applying said pre-charging current further comprises a voltage source operatively connected to an injector driver circuit.

12. The apparatus of claim 11 wherein said means for applying said valve-opening current further comprises said voltage source operatively connected to said injector driver circuit.

13. The apparatus of claim 12 wherein said means for removing current further comprises said injector driver circuit.

14. The apparatus of claim 13 wherein said injector driver circuit further comprises a semiconductor containing voltage limiting circuitry.

15. The apparatus of claim 14 wherein said voltage limiting circuitry further comprises circuitry that reduces the voltage from the supply voltage level to the voltage level required by the fuel injector solenoid.

16. The system of claim 1 wherein said valve opening current is the smallest amperage necessary to minimize the time said armature fully moves.

17. The method of claim 4 where said upper limit is the smallest amperage necessary to minimize the time said armature fully moves.

18. The apparatus of claim 10 wherein upper limit is the smallest amperage necessary to minimize the time said armature fully moves.

19. The system of claim 1 wherein said period sufficient to ensure full opening is greater than 0.1 milliseconds.

20. The apparatus of claim 10 wherein said period to ensure full opening is greater than 0.1 milliseconds.

* * * * *